US007975886B2

(12) United States Patent
McAllister et al.

(10) Patent No.: US 7,975,886 B2
(45) Date of Patent: Jul. 12, 2011

(54) SOCK DONNING SYSTEM

(76) Inventors: John J. McAllister, Leonardtown, MD (US); Michael J. McAllister, Leonardtown, MD (US)

( * ) Notice: Subject to any disclaimer, the term of this patent is extended or adjusted under 35 U.S.C. 154(b) by 93 days.

(21) Appl. No.: 12/457,850

(22) Filed: Jun. 23, 2009

(65) Prior Publication Data

US 2010/0006609 A1 Jan. 14, 2010

Related U.S. Application Data

(60) Provisional application No. 61/129,628, filed on Jul. 8, 2008.

(51) Int. Cl.
*A47G 25/80* (2006.01)

(52) U.S. Cl. ..... 223/111

(58) Field of Classification Search ..... 223/111, 223/112

See application file for complete search history.

(56) References Cited

U.S. PATENT DOCUMENTS

| | | | | |
|---|---|---|---|---|
| 881,163 | A | 3/1908 | Spiess | |
| 3,853,252 | A | 12/1974 | Scianimanico | |
| 3,993,228 | A | 11/1976 | Fuhr | |
| 4,130,226 | A * | 12/1978 | Farrell | 223/111 |
| D259,299 | S | 5/1981 | Vreeken | |
| 5,626,269 | A * | 5/1997 | Duarte | 223/112 |
| 5,687,889 | A | 11/1997 | Liden | |
| 5,709,327 | A * | 1/1998 | LaMacchia et al. | 223/111 |
| 6,056,171 | A | 5/2000 | Santamaria | |
| 6,276,578 | B1 | 8/2001 | Stenger | |
| 6,942,129 | B2 | 9/2005 | Ferraioli | |
| 7,076,973 | B1 | 7/2006 | Chesebro, Jr. et al. | |
| 7,287,675 | B1 | 10/2007 | Sullivan et al. | |
| 2002/0139819 | A1 | 10/2002 | Ferraioli | |
| 2005/0115994 | A1 | 6/2005 | Delamare | |
| 2006/0169005 | A1 | 8/2006 | Chesebro, Jr. et al. | |
| 2007/0062986 | A1 | 3/2007 | Doud | |
| 2007/0119882 | A1 | 5/2007 | Scott | |
| 2009/0272772 | A1 * | 11/2009 | Sullivan et al. | 223/112 |
| 2010/0006609 | A1 * | 1/2010 | Mcallister et al. | 223/111 |

OTHER PUBLICATIONS

Website, http://www.abledata.com/abledata.cfm?pageid=113583&top=0&productid=76283&trail=0, "Bracelet Buddy," two sheets printed from the internet on May 14, 2008.

Website, http://www.activeforever.com/p-590-aluminum-reacher.aspx, "Aluminum Reacher," one sheet printed from the internet on May 14, 2008.

(Continued)

*Primary Examiner* — Shaun R Hurley
*Assistant Examiner* — Andrew W Sutton
(74) *Attorney, Agent, or Firm* — Richard C. Litman

(57) ABSTRACT

The sock donning system enables persons of limited mobility to don socks, stockings, and similar footwear without need for excessive bending at the waist and/or knee. The system includes a pair of identical grasping poles or extensions with remotely operable clasps at their distal ends. Triggers are located adjacent the handles to allow the user to operate the clasps. Socks or stockings are provided with two opposed loops extending from their upper edges or apertures formed near the upper edges. The user secures the clasp of each extension to one of the loops or apertures of a single lo stocking, and uses the two extensions simultaneously to pull the sock over the foot, ankle, and lower leg as applicable. The triggers are operated to open the clasps and release them from the sock, once the sock has been donned. The system may also be of assistance in removing socks.

16 Claims, 4 Drawing Sheets

OTHER PUBLICATIONS

Website, http://www.activeforever.com/p-270-pick-up-reacher.aspx, "Pick-Up Reacher," one sheet printed from the internet on May 14, 2008.

Website, http://www.arthritissupplies.com/site/371928/product/ALP1300, "3 in 1 Hooker Bracelet Fastener," two sheets printed from the internet May 14, 2008.

Website, http://www.arthritissupplies.com/site/371928/page/461285?gclid=CM UysLrppMCFScua . . . , "Reachers, Grabber Reachers, and Folding Reachers for People with Arthritis," three sheets printed from the internet on May 14, 2008.

Website, https://www.housecalls-network.com/oscommerce/product_info.php?products_id=28&osC..., "Dressing Kit," one sheet printed from the internet on May 14, 2008.

Website, https://www.housecalls-network.com/oscommerce/product_info.php?cPath=21&products_..., "Dressing Stick," one sheet printed from the internet on May 14, 2008.

Website, http://www.rehabmart.com/product/18528.htm, "Cord Type Zipper Pull," three sheets printed from the internet on May 14, 2008.

* cited by examiner

SOCK DONNING SYSTEM

CROSS-REFERENCE TO RELATED APPLICATION

This application claims the benefit of U.S. Provisional Patent Application Ser. No. 61/129,628, filed Jul. 8, 2008.

BACKGROUND OF THE INVENTION

1. Field of the Invention

The present invention relates generally to devices and equipment providing assistance to the physically handicapped. More specifically, the present invention is a sock donning system for assisting persons of limited mobility in the donning of socks, stockings, and related footwear.

2. Description of the Related Art

Persons of limited mobility can frequently perform most of the daily tasks required for normal living, including preparing meals, driving, and other routine chores. However, one of the most basic skills required in daily living is often difficult for persons of limited mobility to perform, i.e., donning various articles of clothing. Upper garments are generally not too much of a problem, with front-opening clothing and various extensions for rear opening buttons, zippers and the like being readily available. Skirts, trousers, and the like are also generally not excessively difficult for the person of limited mobility to don and remove, depending upon the degree of impairment of the person.

However, the act of working with the lower extremities, as when donning shoes, socks, and the like, can be impossible without assistance for many persons of limited mobility. The problem may be temporary, e.g., a knee or back injury that prevents complete flexure of the knee or waist, or chronic due to age or disease. Whatever the reason, the requirement that such a person have assistance for what would otherwise be a simple and trivial act can be truly discouraging and demeaning for a person who has been independent of such help up to that time. While various devices for assisting persons in donning socks, stockings, and the like have been developed in the past, they tend either to be ineffective or overly complex.

Thus a sock donning system solving the aforementioned problems is desired.

SUMMARY OF THE INVENTION

The sock donning system enables persons of limited mobility to don socks, stockings and similar footwear without need for excessive bending or flexing at the waist or knee. The system includes a pair of essentially identical grasping extensions and one or more socks or stockings configured for removable attachment to the grasping extensions. Each of the extensions has a handle and adjacent trigger, and an opposite openable clasp actuated by the trigger. The socks each have a pair of loops or apertures extending from or formed in their upper edges. The clasp from each of the extensions is secured to a corresponding loop or aperture of a single sock, and the two extensions are used simultaneously to pull the sock onto the foot of the user. The triggers enable the user to release the clasps from the sock loops or apertures once the sock has been pulled completely onto the foot and over the ankle and lower leg, as applicable. The system may also be of some assistance in the removal of socks and the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a sock donning system, incorporating one or more (preferably at least a few pair) socks having apertures for the temporary attachment of grasping extensions thereto, and elongate grasping extensions for use therewith. The system enables persons of limited mobility to don socks, stockings, and the like without need to bend excessively at the knee or waist.

Figure 1:
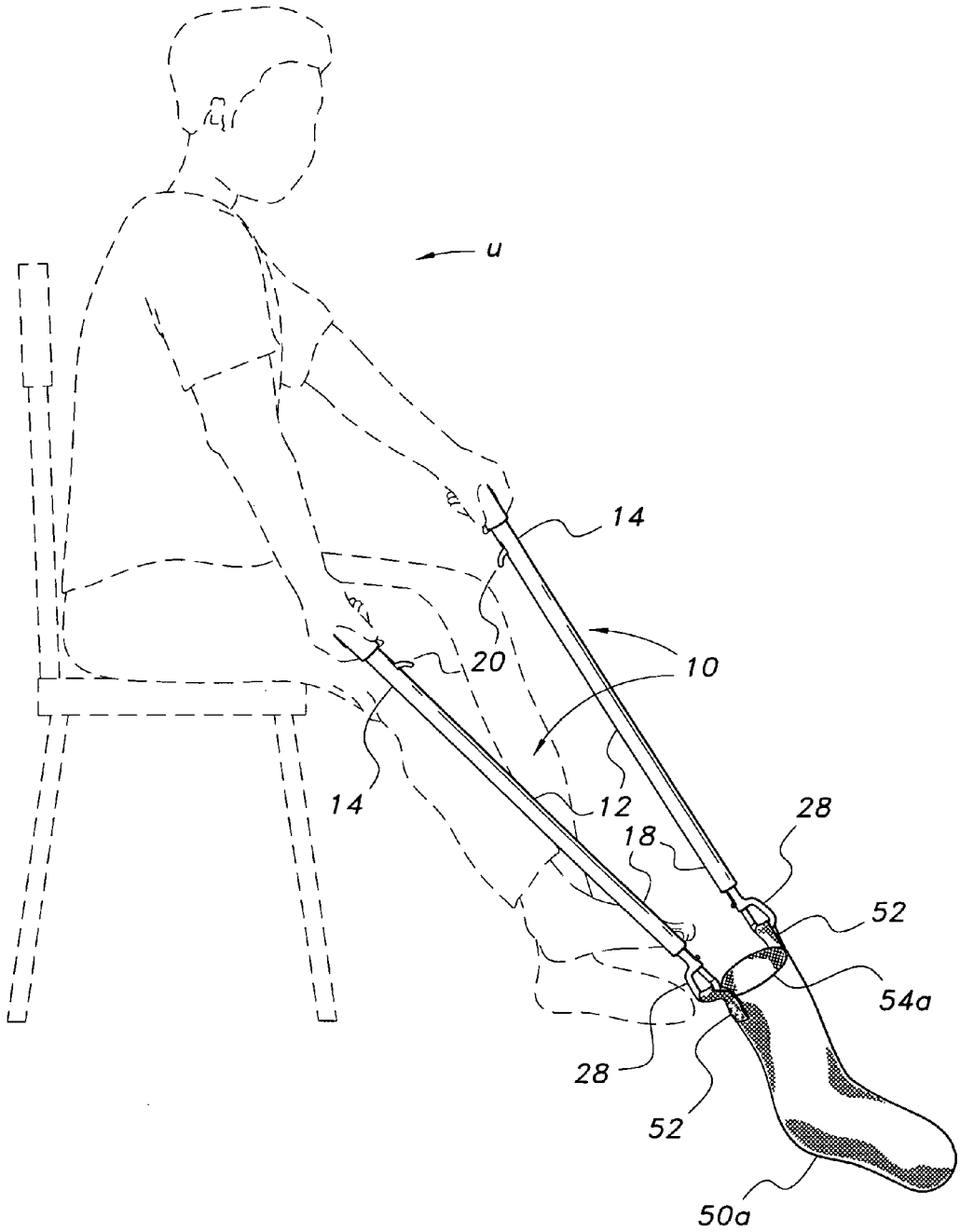
FIG. 1 is an environmental, perspective view of a sock donning system according to the present invention, showing its use and operation.

FIG. 1 provides an environmental perspective view of the system in use. In FIG. 1, a user U is shown manipulating a pair of elongate grasping extensions 10 temporarily secured to a sock or stocking 50*a*. The sock 50*a* has mutually opposed first and second loops 52 extending from the upper edge 54*a* thereof. The loops 52 accept the sock aperture clasps extending from the distal ends of the two extensions 10, enabling the user U to don the sock or stocking 50*a* (and others suitably configured) without excessive bending or exertion.

Figure 2:
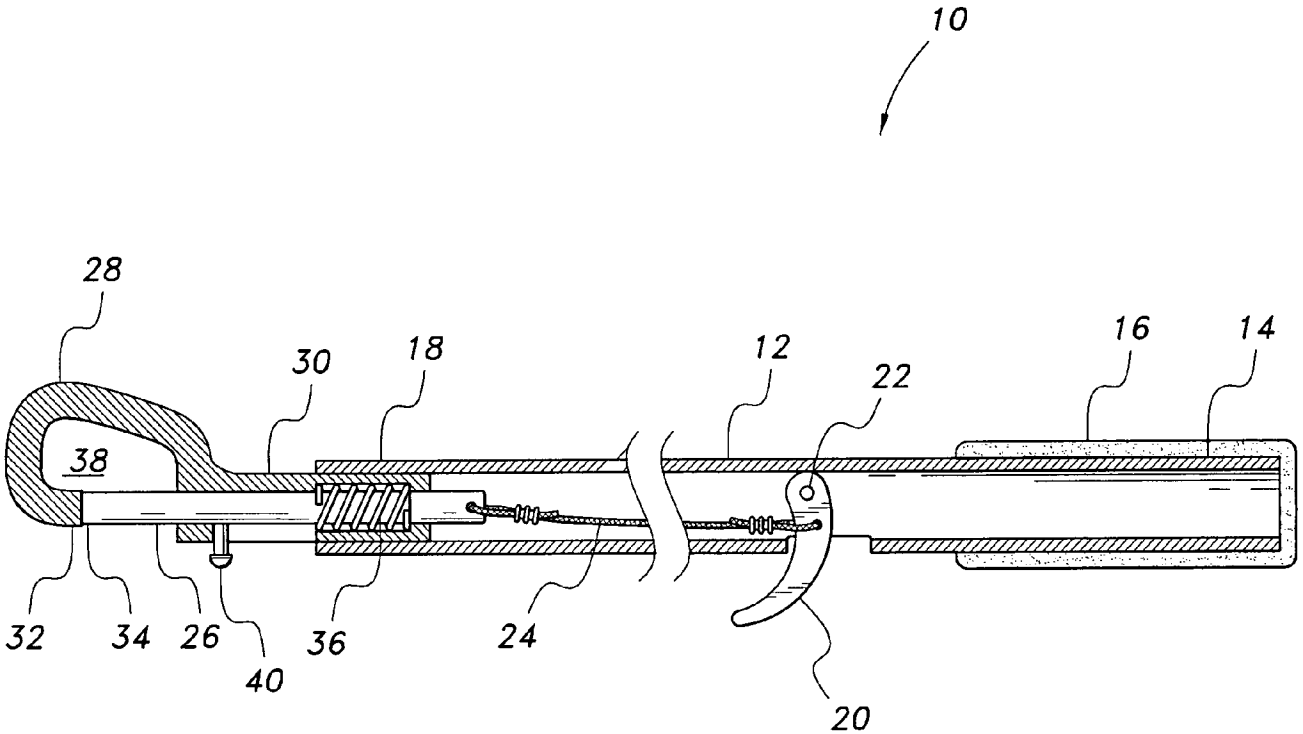
FIG. 2 is a side elevation view in section of a single grasping pole of the sock donning system, illustrating internal details thereof.

FIG. 2 provides a detailed side elevation view in section of an exemplary grasping extension 10. The grasping extension 10 comprises an elongate hollow pole or shaft 12 having a handle end 14 (preferably with a handgrip 16 having cushioning and/or a high coefficient of friction to provide a good grip for the user U) and an opposite, distal grasping end 18. A clasp actuator 20 (e.g., a trigger, etc.) extends at least generally radially from the pole or shaft 12 adjacent the handle end 14 of the device 10. The actuator or trigger 20 is secured within the pole or shaft 12 by a pivot pin 22 extending therethrough.

A tension member 24 (e.g., a cable, cord, rigid or flexible wire, etc.) extends from its attachment to the trigger or actuator 20 to its opposite end attachment to a linearly sliding closure member 26 extending from the grasping end 18 of the pole 12, enabling the actuator 20 to communicate mechanically with the closure member 26. A hook 28 has a barrel portion 30 affixed within the grasping end 18 of the pole 12, with a tip portion 32 at least generally coaxially aligned with the center of the barrel portion 30 and the grasping end 18 of the extension pole 12. The closure member 26 is aligned with the tip portion 32 of the hook 28, with the distal tip 34 of the sliding closure member 26 being urged into contact with the tip 32 of the hook 28 by a spring 36 disposed about the closure member 26 and captured within the barrel 30 of the hook 28. The normally closed closure member 26 and the hook 28 define a closed grasping ring 38 when the tip 34 of the closure member 26 is in contact with the tip 32 of the hook 28.

However, movement of the clasp or closure member actuator 20 toward the handle end 16 of the pole 12 pulls the tension member 24 and, thus, the closure member 26, toward the handle end 16 of the pole 12 to open the clasp for removable attachment to an object, e.g., one of the loops 52 of the sock 50*a*. Alternatively an actuator button 40 extends laterally from the closure member 26 through a slot in the barrel 30 of the hook 28, thereby enabling the user to manipulate the closure member 26 directly to selectively open and close the clasp assembly as desired.

The system is used by initially hooking or connecting the clasp of each of the two extensions 10 to a corresponding aperture along the upper edge of one of the socks to be donned, e.g., through the loop 52 extending from each side of the upper edge 54*a* of the sock 50*a*. This is most easily accomplished by holding the extension 10 adjacent its distal grasping end 18 and opening the clasp assembly by sliding the actuator button 40 (and thus the closure member 26 as well) toward the handgrip end of the extension 10, thereby opening the grasping ring 40 of the clasp assembly. The tip 32 of the clasp hook 28 is inserted through one of the loops 52 of the sock or stocking 50*a*, and the actuator button 40 is released to allow the closure member 26 to slide closed to capture the sock loop 52 within the grasping ring 40 of the clasp assembly. This operation is repeated with the second extension 10 and the second sock loop 52 of the sock 50*a*.

Once the socks or stockings have been temporarily secured to the clasp assemblies of the two extensions, the user manipulates the extensions to pull the sock or stocking over his or her foot, generally as illustrated in FIG. 1 of the drawings. The user U grasps the two extensions at their handle ends 14 and pulls the two extensions generally upwardly toward him or herself. The sock or stocking remains firmly, but temporarily, attached to the two extensions 10, with the user U being able to manipulate the sock opening or upper edge as required to pass over the foot. Manipulation is continued until the sock has covered the foot and ankle and extends upwardly above the ankle, according to the length of the sock.

Once the sock has been pulled completely over the foot and ankle, the user U may manipulate the triggers or actuators 20 adjacent the handgrip ends 14 of the two extensions 10 to open the grasping rings 38. The extensions 10 are lowered slightly, i.e., moved slightly toward the sock or stocking, to provide some slack, and the hooks 28 are removed from their respective sock apertures (loops 52, etc.) to complete the task.

Figure 3:
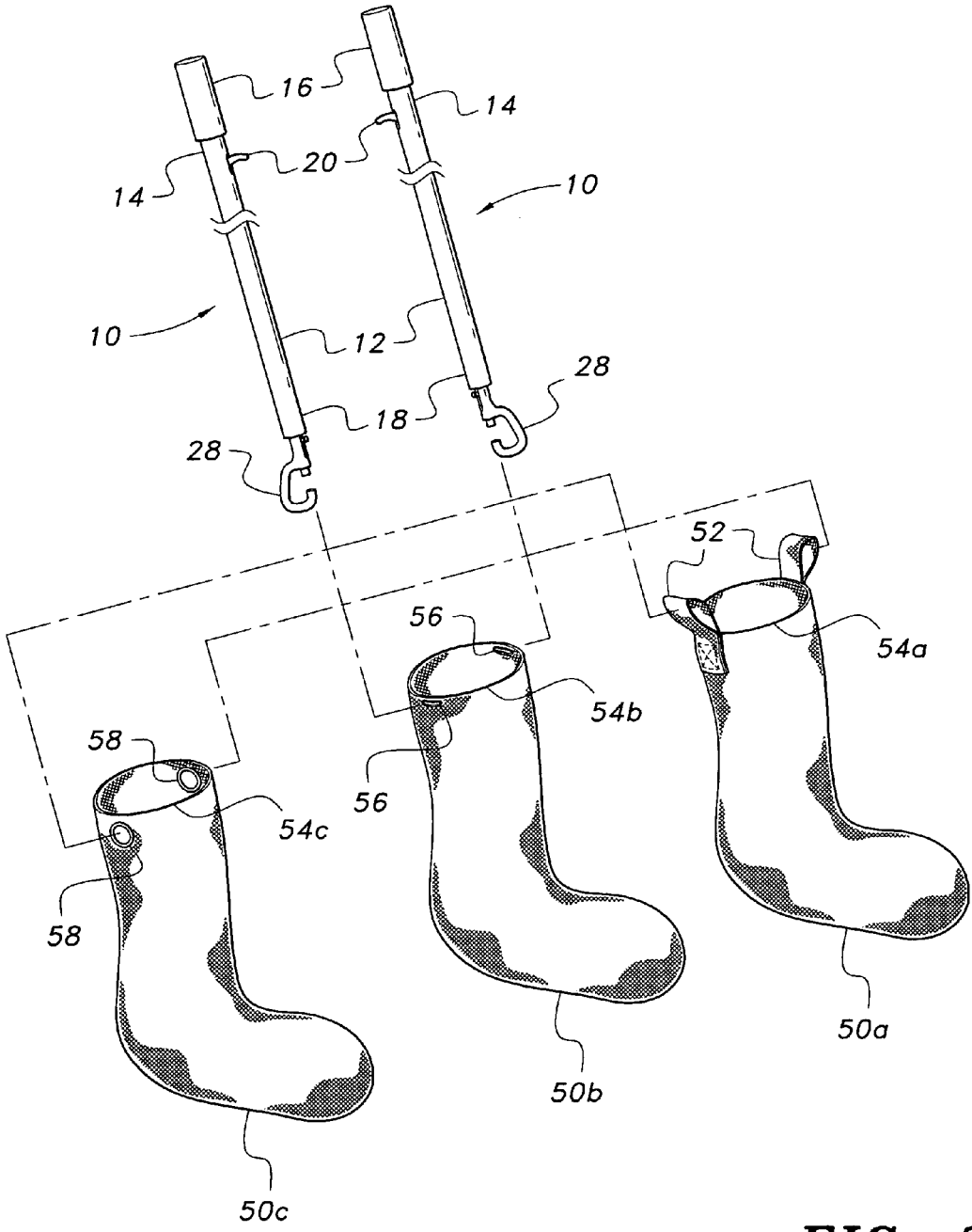
FIG. 3 is an exploded perspective view of the two poles of the sock donning system with a series of alternative configuration socks.

FIG. 3 illustrates three different exemplary socks 50*a*, 50*b*, and 50*c* that may be provided with the sock donning system. Sock 50*a* with its extension attachment aperture loops 52 has been discussed in detail further above. Alternatively, a sock or stocking 50*b* may be provided with apertures 56 formed directly through the material adjacent the upper edge 54*b* of the sock. In the case of the sock or stocking 50*b*, these apertures are relatively narrow reinforced slits, much like buttonholes. The third sock 50*c* of FIG. 3 includes a different type of aperture 58, with the two apertures 58 of the sock 50*c* being formed as open grommets adjacent the upper edge 54*c*. The grommet apertures 58 preferably have reinforced peripheries. Other configurations of grasping extension apertures may be formed along or extending from the upper edges of the socks or stockings, as desired. The specific form of the apertures provided through or extending from the upper edge of the sock or stocking is not critical, so long as they provide for the temporary attachment of the hooks 28 or clasp assemblies of the two extensions 10.

Figure 4:
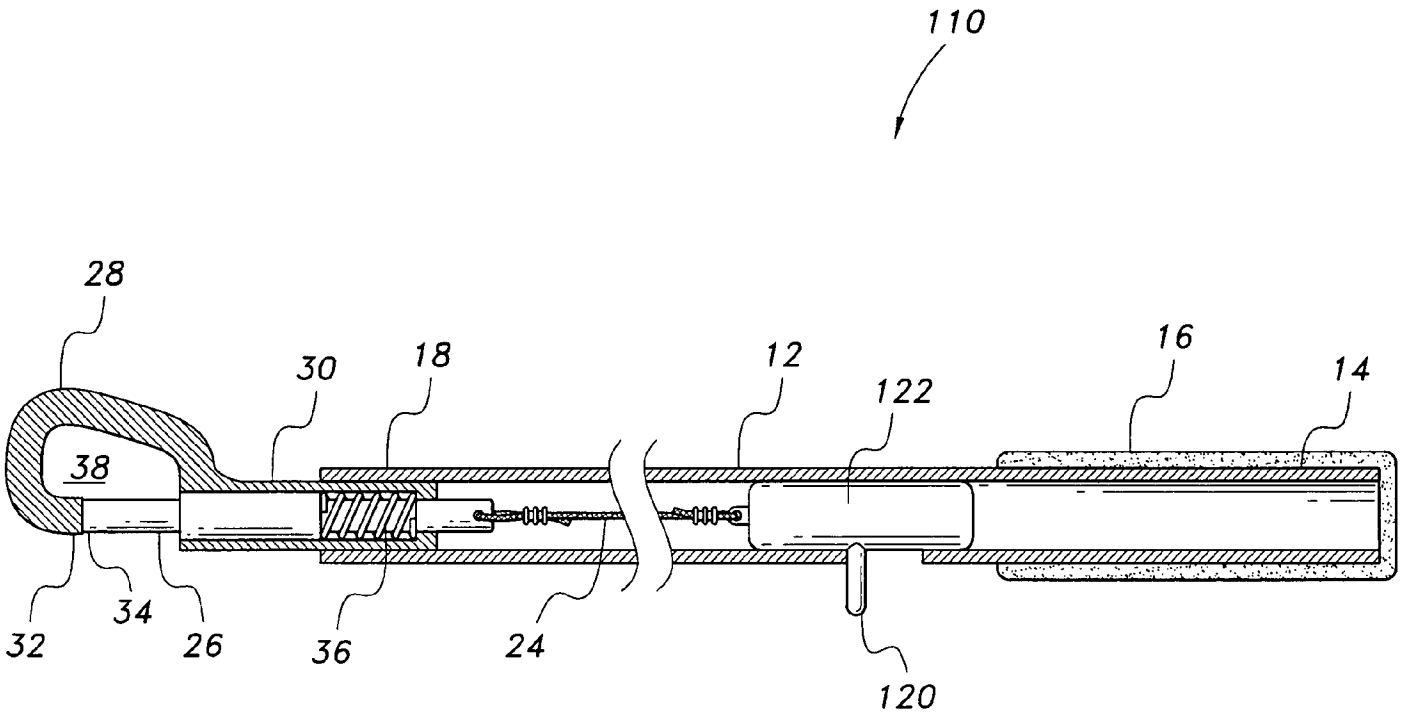
FIG. 4 is a side elevation view in section of an alternative embodiment of the single grasping pole illustrated in FIG. 2.

FIG. 4 of the drawings is a side elevation view in section of an alternative embodiment of a grasping extension, designated as extension 110. The extension 110 comprises an elongate hollow shaft or pole 12 having a handle end 14 with a handgrip 16 thereon and an opposite distal grasping end 18, just as in the case of the grasping extensions 10 of FIGS. 1 through 3. The sliding closure member 26, hook 28, hook barrel 30, hook tip 32, closure member tip 34, spring 36, and grasping ring 38 defined by the hook 28 and closure member 26, are all essentially the same as in the grasping extensions 10 of FIGS. 1 through 3, with the exception of the lack of an actuator button extending from the sliding closure member to permit direct opening of the closure member.

A tension member 24, e.g., a cable, extends from the end of the closure member 26 within the distal end 18 of the hollow pole 12, toward the opposite handle end 14 of the pole. However, rather than connecting to a pivotally mounted trigger, as in the first extension embodiment of FIGS. 1 through 3, the tension member 24 connects to a slide 122 that fits closely within the hollow pole 12 and slides axially back and forth for a short distance within the pole 12. A trigger 120 extends generally radially from the slide 122, through a slot formed in the side of the pole 12. The spring 36 draws the tension member 24, and thus the slide 122, toward the distal end 18 of the pole 12, thus closing the sliding closure member 26 against the hook tip 32. However, when the user draws the trigger 120 axially toward the handle end 14 of the pole, the slide 122 pulls the tension member 24 and its attached closure member 26 toward the handle end 14 of the pole 12 to open the hook 28 and allow it to be installed upon a sock loop or aperture. Thus, operation of the grasping extension 110 is substantially like that of the extension 10, with the exception of the lack of a distal button for manipulating the closure member and the axial motion of the trigger 120.

It is to be understood that the present invention is not limited to the embodiments described above, but encompasses any and all embodiments within the scope of the following claims.

We claim:

1. A sock donning system, comprising in combination:

a plurality of socks, each of the socks having an upper edge and mutually opposed first and second apertures defined along the upper edge; and first and second grasping extensions, each of the extensions having;

an elongated pole having a handle end and a distal grasping end opposite the handle end;

a fixed hook extending from the grasping end of the pole, the hook further having a tip at least generally coaxially aligned with the distal grasping end;

a linearly sliding closure member extending from the grasping end of the pole and aligned with the tip of the hook, the closure member having a distal tip selectively contacting the tip of the hook, the closure member and hook defining a closed grasping ring when the tip of the closure member is in contact with the tip of the hook;

a spring urging the distal tip of the closure member into contact with the tip ofthe hook;

a closure member actuator extending from each of the poles adjacent the handle end thereof; and a tension member disposed within each ofthe poles and extending from the actuator to the closure member.

2. The sock donning system according to claim 1, further comprising an actuator button extending laterally from the closure member.

3. The sock donning system according to claim 1, wherein the closure member actuator comprises a trigger pivotally extending radially from the pole.

4. The sock donning system according to claim 1, wherein the closure member actuator comprises an axially sliding trigger extending radially from the pole.

5. The sock donning system according to claim 1, wherein each of the socks further includes mutually opposed first and second loops extending from the upper edge thereof, the loops respectively defining first and second apertures therethrough.

6. The sock donning system according to claim 1, wherein the apertures defined in the socks comprise buttonhole slits.

7. The sock donning system according to claim 1, further comprising grommets disposed about the apertures in the socks.

8. A sock donning system, comprising:

at least one sock having an upper edge and at least one aperture defined alone the upper edge; and at least one elongated hollow grasping extension, the at least one extension having;

a handle end and a distal grasping end opposite the handle end;

a fixed hook extending from the grasping end of the extension, the hook having a tip at least generally coaxially aligned with the distal grasping end of the extension;

a linearly sliding closure member extending from the grasping end of the extension and aligned with the tip ofthe hook, the closure member having a distal tip selectively contacting the tip of the hook, the closure member and hook defining a closed grasping ring when the tip of the closure member is in contact with the tip of the hook;

a spring urging the distal tip of the closure member into contact with the tip ofthe hook;

a closure member actuator extending from the extension adjacent the handle end thereof; and a tension member disposed within the extension and extending from the actuator to the closure member.

9. The sock donning system according to claim 8, wherein said at least one sock comprises a plurality of socks.

10. The sock donning system according to claim 8, wherein the closure member actuator comprises a trigger pivotally extending radially from the extension.

11. The sock donning system according to claim 8, wherein the closure member actuator comprises an axially sliding trigger extending radially from the extension.

12. The sock donning system according to claim 8, further comprising an actuator button extending laterally from the closure member.

13. The sock donning system according to claim 8, wherein the at least one sock further includes mutually opposed first and second loops extending from the upper edge thereof, the loops respectively defining first and second apertures therethrough.

14. The sock donning system according to claim 8, wherein the apertures of the at least one sock comprise buttonhole slits.

15. The sock donning system according to claim 8, further comprising a grommet disposed about the at least one aperture in the at least one sock.

16. A method of donning a sock, comprising the steps of:

(a) providing a plurality of socks each having an upper edge with a pair of apertures therealong;

(b) further providing a pair of elongated grasping extensions, each having a selectively openable sock aperture clasp extending from the distal end and a clasp actuator disposed adjacent the handle end, and communicating with the sock aperture clasp;

(c) attaching the sock aperture clasp of each of the extensions through one of the apertures of one of the socks;

(d) pulling the sock over at least the foot and ankle of the user by simultaneously manipulating the pair of grasping extensions; and (e) releasing the sock aperture clasps of the grasping extensions from the sock by operating the clasp actuator of each of the grasping extensions and manipulating the extensions.

* * * * *